United States Patent [19]

Soofi

[11] Patent Number: 4,901,985

[45] Date of Patent: Feb. 20, 1990

[54] APPARATUS FOR SPRAYING REFRACTORY LINING

[75] Inventor: Madjid Soofi, St. Charles, Ill.

[73] Assignee: Magneco/Metrel, Inc., Addison, Ill.

[21] Appl. No.: 269,924

[22] Filed: Nov. 10, 1988

[51] Int. Cl.[4] ..... L21B 7/04

[52] U.S. Cl. ..... 266/281; 264/30

[58] Field of Search ..... 266/281; 264/30; 239/142, 187, 227, 225, 8

[56] References Cited

U.S. PATENT DOCUMENTS

| | | | |
|---|---|---|---|
| 3,276,695 | 10/1966 | Giardino et al. | 239/142 |
| 3,351,289 | 11/1967 | Demaison | 239/132.3 |
| 3,416,732 | 12/1968 | Reiter | 239/227 |
| 3,473,737 | 10/1969 | Bowman | 239/187 |
| 3,797,745 | 3/1974 | Haus | 239/227 |
| 3,799,445 | 3/1974 | Marino | 239/225 |
| 3,830,430 | 8/1974 | Hartunian | 239/186 |
| 3,902,669 | 9/1975 | Keibler | 239/227 |
| 3,957,203 | 5/1976 | Bullard | 239/128 |
| 4,099,708 | 7/1978 | Morris et al. | 266/281 |
| 4,127,626 | 11/1978 | Kubo et al. | 266/281 |
| 4,128,207 | 12/1978 | Pacht et al. | 239/186 |
| 4,167,246 | 9/1979 | Haus | 239/227 |
| 4,171,094 | 10/1979 | Helfen | 239/186 |
| 4,181,258 | 1/1980 | Ogawa | 239/186 |
| 4,211,367 | 7/1980 | Allison | 239/226 |
| 4,220,282 | 9/1980 | Behr | 239/187 |
| 4,222,522 | 9/1980 | Kubo et al. | 239/160 |
| 4,253,646 | 3/1981 | Goto et al. | 266/281 |
| 4,272,018 | 6/1981 | Hickson | 239/8 |
| 4,272,020 | 6/1981 | Allison | 239/8 |
| 4,274,590 | 6/1981 | Hammelmann | 239/185 |
| 4,301,998 | 11/1981 | Rodway | 266/281 |
| 4,421,275 | 12/1983 | Gratton | 239/226 |
| 4,461,789 | 7/1984 | Takashima | 427/426 |
| 4,494,737 | 1/1985 | Rymarchyk, Jr. et al. | 266/281 |
| 4,570,909 | 2/1986 | Hiroki et al. | 266/281 |
| 4,690,328 | 9/1987 | Roehl | 239/227 |

OTHER PUBLICATIONS

Nov., 1986, *Iron & Steelmaker* article entitled, "A Study Comparing Insulative Tundish Lining Systems at Rouge Steel Company".

*Primary Examiner*—S. Kastler

*Attorney, Agent, or Firm*—Willian Brinks Olds Hofer Gilson & Lione

[57] ABSTRACT

An apparatus which is adapted to move along a tundish, ladle, or the like having a generally closed lower end, enclosed sides, and an open upper end. The apparatus sprays the sides and lower end of the tundish with refractory material. The apparatus comprises a nozzle having an inlet and an outlet, and a base movable in an x direction generally horizontally along the tundish, a boom movable in a vertical y direction, a lance movable in a z direction generally perpendicular to the x and y directions, and a rotatably swivel bracket for rotating the nozzle outlet about an axis extending in the y direction. The apparatus also includes piping for supplying fluidized refractory material to the nozzle inlet, and a water ring for wetting the fluidized material before the nozzle outlet.

10 Claims, 4 Drawing Sheets

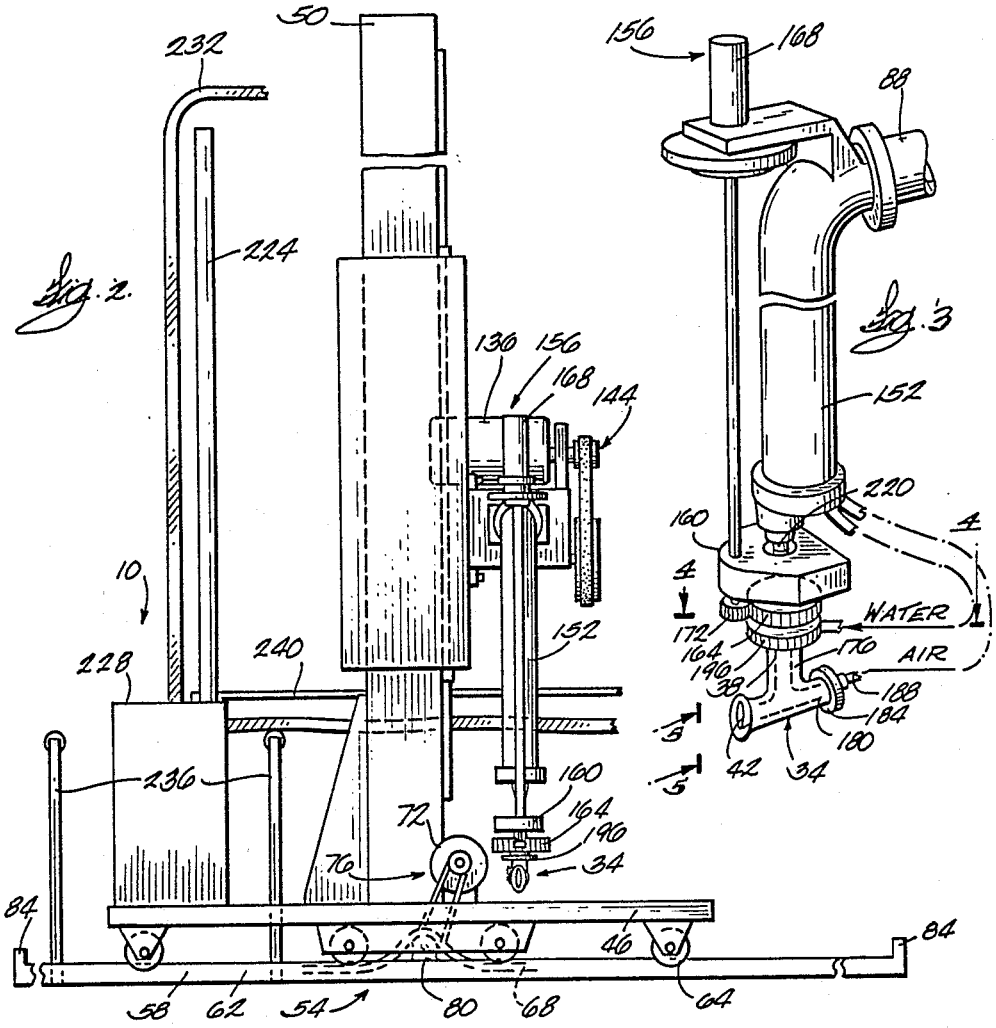
Fig. 2.
Fig. 3
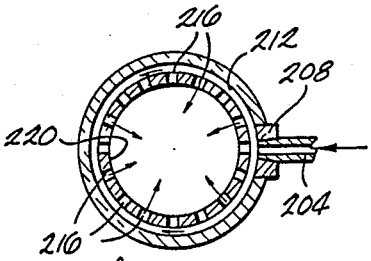
Fig. 4
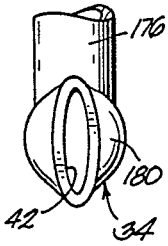
Fig. 5
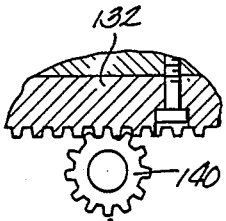
Fig. 6

APPARATUS FOR SPRAYING REFRACTORY LINING

FIELD OF THE INVENTION

This invention relates to apparatus for gunning refractory material on the interior of a tundish ladle or the like used in the manufacture of molten iron or steel More particularly, this invention relates to such gunning apparatus which are adapted to move along the tundish and spray the sides and the lower end thereof.

In the iron and steel industry, deep walled refractory bodies such as tundishes ladles and the like, are subjected to extremely high temperatures over a long period of time. The high temperatures cause deterioration of the refractory linings of the bodies. After the lining is deteriorated to a certain point, the lining must be replaced or repaired before the tundish can be further used.

The interior surface of the tundish can be repaired in a number of different ways. One common repair method has been to spray a protective coating of refractory material onto the interior of the tundish. Refractory spraying apparatus in common use are usually hand operated devices. Workmen are required to enter the tundish and to hand spray the refractory material about the interior.

Various prior art devices have been offered as apparatus for accomplishing the spraying of the interior of the tundish without the need for workmen to enter the tundish. One such apparatus is disclosed in Bowman U.S. Pat. No. 3,473,739 issued Oct. 21, 1969. Examples of other remote gunning apparatus include Bullard U.S. Pat. No. 3,957,203 issued May 19, 1976, and Haus U.S. Pat. No. 4,167,246 issued Sept. 11, 1979.

SUMMARY OF THE INVENTION

Disclosed is an apparatus which is adapted to move along a tundish, ladle, or the like having a generally closed lower end, enclosed sides, and an open upper end. The apparatus sprays the sides and lower end of the tundish with refractory material. The apparatus comprises a nozzle having an inlet and an outlet, means for supporting the nozzle inside the tundish, x means for moving the nozzle support in an x direction generally horizontally along the tundish, y means for moving the nozzle support in a vertical y direction, z means for moving the nozzle support in a z direction generally perpendicular to the x and y directions, and w means for rotating the nozzle outlet about an axis extending in the y direction. The apparatus also includes means for supplying fluidized refractory material to the nozzle inlet, and means for wetting the fluidized material before the nozzle outlet.

In one embodiment, the apparatus further includes means for operating said x, y, z and w moving means in a coordinated fashion, and means for supplying air to the nozzle outlet to assist in propelling the wetted refractory material against the tundish.

In one embodiment, the apparatus comprises a base, an upright support beam attached to the base, means for moving the base horizontally along the tundish, and a horizontal boom extending generally perpendicularly to the direction of travel of the base and extending over the open upper end of the tundish. The apparatus also includes a cradle slidably mounted on the support beam and slidably supporting the boom, means for moving the boom horizontally relative to the cradle, and means for moving the cradle vertically relative to the support beam. The apparatus also includes a lance attached to the boom and perpendicular thereto which extends generally into the tundish, and which has a lower end, a nozzle having an inlet and an outlet, and means for rotatably mounting the nozzle on the lance lower end so that the nozzle outlet is generally perpendicular to the lance. The apparatus also includes means for rotatably moving the nozzle relative to the lance.

One of the principle features of the invention is the provision of a gunning apparatus to line refractory bodies such as tundishes and the like, which apparatus is of simple construction and which can be used in present day iron and steel making installations without the need for substantial modification to provide additional space for the apparatus.

Another of the principle features of the invention is the provision of such a gunning apparatus which can be automated so that once the particular perimeter points of the refractory body have been memorized the machine can automatically line the refractory body.

Another of the principle features of the invention is the provision of such a gunning apparatus which permits fluidized refractory material to be transported from a gunning machine to the gunning nozzle over a great distance, at which time an air assist is provided to assist in propelling the refractory material against the inside of the refractory body.

Other features and advantages of embodiments of the invention will become known by reference to the following drawings, general description, and appended claims.

BRIEF DESCRIPTION OF THE DRAWINGS

FIG. 3 is an enlarged view of the lance and nozzle portion of the gunning apparatus.

FIG. 4 is a cross-sectional view of the water ring portion of the gunning apparatus taken along with line 4—4 in FIG. 3.

FIG. 5 is a front view of the nozzle outlet taken along the line 5—5 in FIG. 3.

FIG. 6 is a cross-sectional view of the combination rack and motor provided for moving the boom of the gunning apparatus relative to its support cradle.

FIG. 9 is a schematic illustration of the mechanism provided for operating the electric motors which move the various components of the gunning apparatus.

Figure 1:
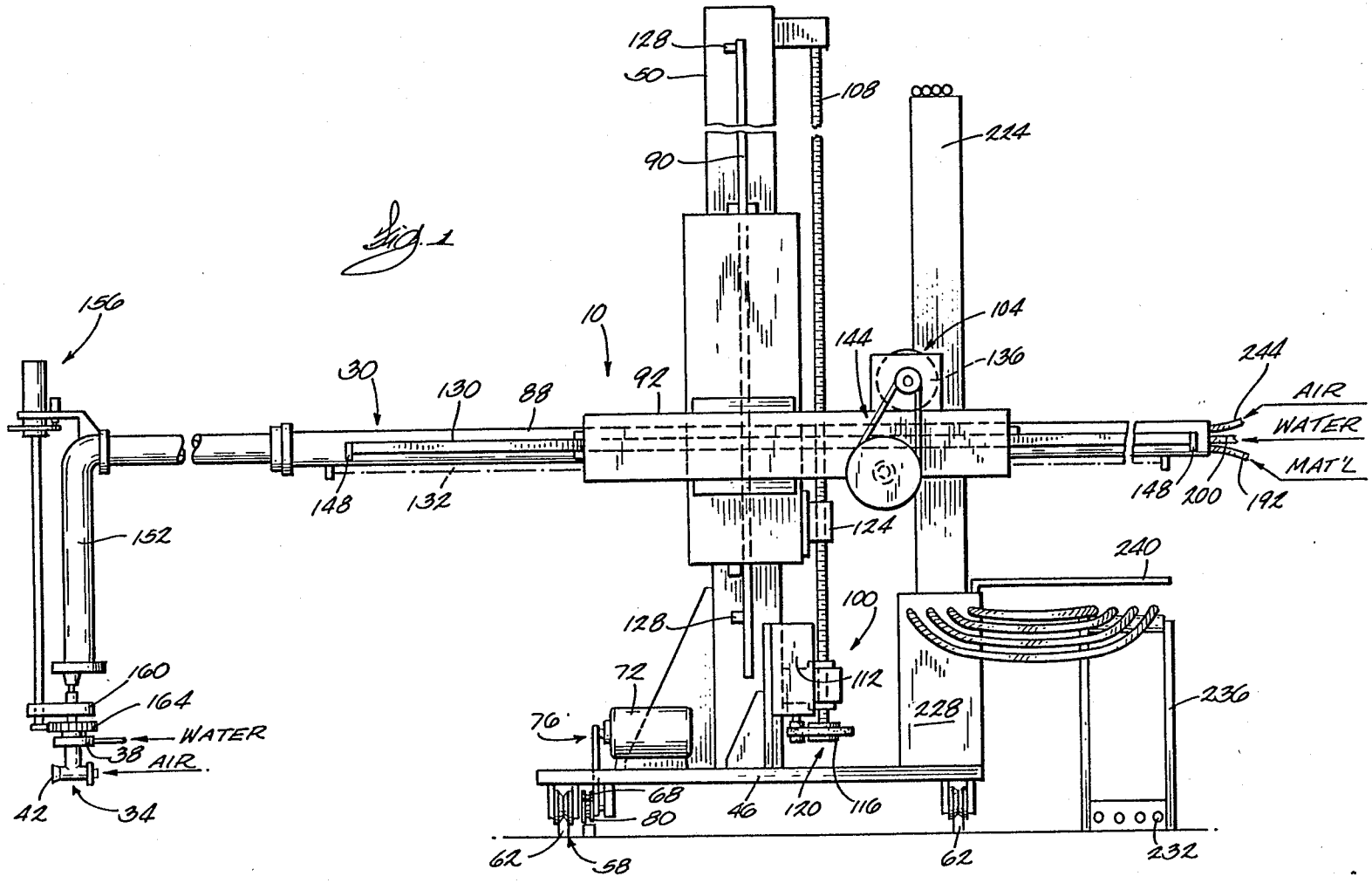
FIG. 1 is a side elevational view of a gunning apparatus which embodies various features of the invention.

Before explaining at least one of the embodiments of the invention in detail, it is to be understood that the invention is not limited in its application to the details of construction and the arrangement of components set forth in the following description or illustrated in the drawings The invention is capable of other embodiments and of being practiced or carried out in various ways. Also, it is to be understood that the terminology employed herein is for the purposes of description and should not be regarded as limiting.

DESCRIPTION OF THE PREFERRED EMBODIMENT

Figure 2:
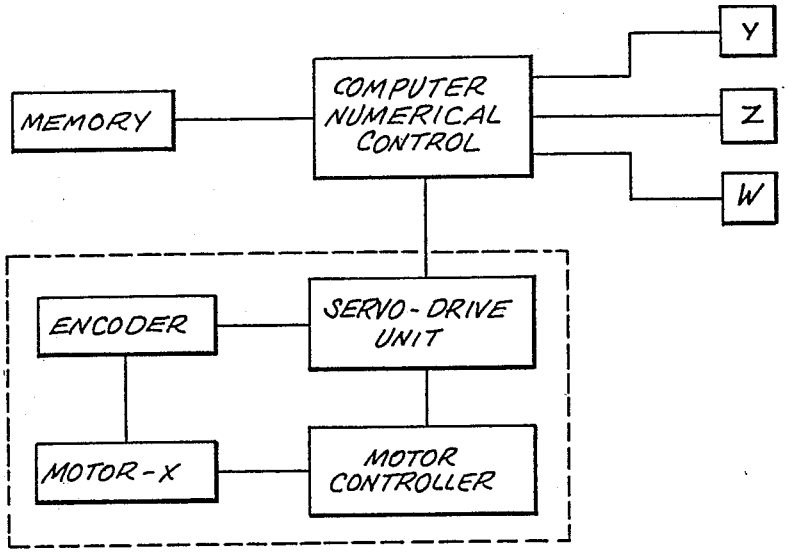
FIG. 2 is a front elevational view of the gunning apparatus illustrated in FIG. 1.

FIGS. 1 and 2 illustrate an apparatus 10 which is adapted to move along a tundish 14, ladle or other type of refractory body generally used in the iron or steel making industry. The refractory body 14 receives molten metal such as steel at very high temperatures. Because the high temperatures tend to deteriorate the interior of the refractory body, a refractory material lining is applied to the interior of the body, is consumed during the use of the vessel, and is then replaced. The apparatus 10 illustrated automatically applies the refractory material to the inside of the refractory body 14 without the need for continuing operator control.

Figure 7:
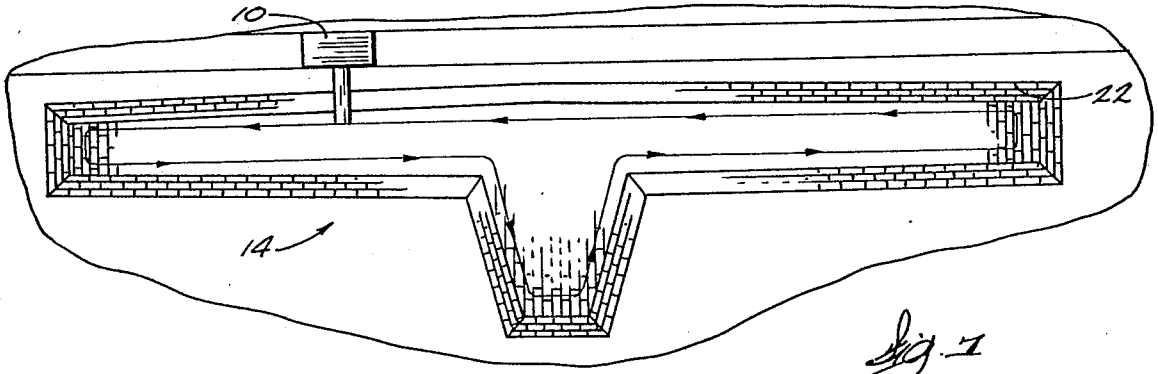
FIG. 7 is a top view of a tundish showing the direction of movement of the gunning apparatus nozzle relative to the tundish.
Figure 8:
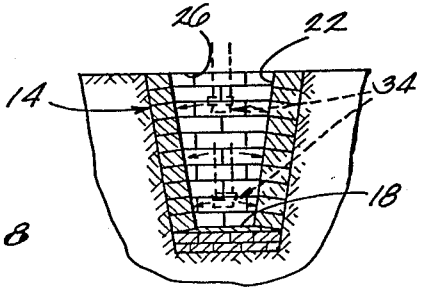
FIG. 8 is a vertical cross-sectional view of a tundish showing the vertical movement of the nozzle of the gunning apparatus relative to the tundish.

More particularly, as illustrated in FIGS. 7 and 8 the refractory body is in the form of a tundish 14 which includes a generally closed lower end 18, enclosed sides 22, and an open upper end 26. The closed lower end 18 usually includes openings (not shown) for providing an exit for the molten steel. Baffles (not shown) may also be placed within the tundish 14 before or after the refractory lining is applied.

The apparatus 10 comprises means 30 for supporting inside the tundish 14 a nozzle 34 having an inlet 38 and an outlet 42. The nozzle supporting means 30 includes a base 46, an upright support beam 50 attached to the base 46, and x means 54 for moving the base 46 horizontally along the tundish 14 so that the nozzle 34 is moved in an x direction generally horizontally along the tundish 14.

More particularly, the base moving means 54 comprises a track 58 in the form of spaced apart rails 62 extending generally along one of the sides of the tundish 14 (see FIG. 1). The base moving means 54 also includes means for permitting movement of the base along the track which, in this embodiment, comprises wheels 64 which are guided for movement by the track 58. The base moving means 54 also includes a chain 68 extending the length of and fixed to the track 58. More particularly, the chain 68 is connected at each end thereof to each end of one of the track rails 62. The base moving means 54 further includes a motor 72 which is connected to the base 46, and which engages the chain 68 so that the base 46 moves along the track 58 when the motor operates. More particularly, the motor is connected through an appropriate transmission 76 to a gear 80 which is rotatably mounted on the base 46 and which engages the chain 68. As the gear 80 rotates relative to the chain 68, the gear 80 and the base 46 move relative to the chain 68 along the track 58. Limit switches 84 are provided at the end of the track 58 to prevent the base 46 from having off the track 58. The provision of the base moving means 54 with a positive drive including the motor 72, the transmission 76, the gear 80, and the chain 68 provides for precise control of the movement of the base 46, and the nozzle 34 supported by the support beam 50 attached to the base 46, along the track 58.

The gunning apparatus 10 also includes a horizontal boom 88 extending generally perpendicularly to the direction of travel of the base 46, and extending over the open upper end 26 of the tundish 14. The apparatus 10 also includes a cradle 92 slidably mounted on the support beam 50 and slidably supporting the boom 88. A guide 96 is provided on the support beam 50 to prevent rotational movement of the cradle 92 relative to the support beam 50. The apparatus 10 also includes y means 100 for moving the cradle 92 and the nozzle 34 attached thereto vertically relative to the support beam 50 in a y direction, and z means 104 for moving the boom 88 and the nozzle 34 attached thereto horizontally relative to the cradle 92 in a z direction generally perpendicular to the x and y directions.

More particularly, the cradle moving means 100 comprises a screw 108 mounted adjacent to the support beam 50 and extending the length of the support beam 50. The ends of the screw are rotatably attached, as illustrated in FIG. 1, to the top and bottom of the support beam 50. The cradle moving means 100 also includes means for rotating the screw 108 in the form of a motor 112 attached to the support beam 50 adjacent to the lower end of the screw 108, a gear 116 on the end of the screw 108, and an appropriate transmission 120 connected between the motor 112 and the gear 116. The cradle moving means further includes a threaded nut 124 attached to the cradle 92 and receiving the screw 108 so that the cradle 92 moves relative to the support beam 50 and the screw 108 as the screw 108 turns. Limit switches 128 are provided at either end of the support beam 50 to prevent the cradle 92 from moving off the ends of the support beam 50. This direct drive between the cradle 92 and the support beam 50 allows for precise movement of the cradle 92 and the boom 88 supported therein relative to the support beam 50, thereby permitting precise control of the location of the nozzle 34 within the tundish 14.

The means 104 for moving the boom 88 relative to the cradle 92 comprises a rack 132 on the lower side of the boom 88, and a motor 136 on the cradle 92 for engaging the rack 132 so that the boom 132 moves relative to the cradle 92 when the motor operates. More particularly as illustrated in FIG. 6, the motor 136 is mounted on the cradle 92, and the boom moving means 104 further includes a gear 140 which engages the rack 132 on the lower side of the boom 88, and an appropriate transmission 144 between the motor and the gear. Limit switches 148 are provided at either end of the boom 88 to prevent the boom 88 from coming out of the cradle 92. Again, a direct drive for precise control of the nozzle 34 is thus provided.

The apparatus 10 further includes a lance 152 attached to the boom 88 and perpendicular thereto, which extends generally into the tundish 14, and which has a lower end, as illustrated in FIGS. 1 and 2. The apparatus 10 also includes w means 156 for rotatably moving the nozzle 34 relative to the lance 152 so that the nozzle outlet 42 is generally perpendicular to the lance 152 and so that the nozzle outlet 42 is rotated about an axis extending in the y direction. More particularly, the w means comprises a mounting plate 160 attached to the lance lower end and a swivel bracket 164 rotatably mounted on the mounting plate 160. The nozzle 34 is attached to the swivel bracket 164, and the w means further includes a motor 168 for engaging the swivel bracket 164 so that the swivel bracket 164 rotates when the motor 108 operates. More particularly, the motor 168 includes a gear 172 which engages teeth on the swivel bracket 164, as illustrated in FIG. 3.

As illustrated in FIGS. 3 and 5, the nozzle 34 is generally a T-shaped piece including a vertical portion 176 and a generally horizontal portion 180 including an open end which forms the nozzle outlet 42. The interior of the vertical portion 176 and the outlet portion of the horizontal portion 180 are generally hollow, and are lined with a resilient boot (not shown) made of polyurethane. The rear of the horizontal portion of the nozzle 34 includes a cap 184 with an opening forming an air inlet 188 into the nozzle outlet 42, as further explained below.

The gunning apparatus 10 further includes means 192 for supplying fluidized refractory material to the nozzle inlet 38, means 196 for wetting the fluidized material before the nozzle outlet 42, and means 200 for supplying water to the wetting means. More particularly, the boom 88 and the lance 152 are hollow, and the water and material supplying means extend through the boom 88 and the lance 152. A pressurized supply of water (not shown) is located near the apparatus 10, and the water supply is connected by tubing 204 extending through the boom 88 from one end thereof as generally illustrated in FIG. 1, to the other end of the boom 88, and then down the lance 152 to where it then exists the lower end of the lance 152. The tubing 204 is then connected, as illustrated in FIG. 3, to the means 208 for wetting the fluidized material before the nozzle outlet.

The wetting means is in the form of a water ring 196 of conventional construction connected to the nozzle inlet 38. The water ring 196, as illustrated in FIG. 4, includes a water inlet 208 into an annular space 212. The interior of the water ring 196 includes a plurality of openings 216 which spray water from the annular space 212 into the interior of the water ring 196. The water supply tubing 204 is connected to the water inlet 208.

The means 192 for supplying the fluidized refractory material to the nozzle inlet 38 includes a conventional gunning tank (not shown) of the type which takes granular refractory material, mixes it with compressed air, and then forces the fluidized material through appropriate piping. An example of one such gunning tank is available from the Reed Company. Piping 220 from the gunning tank extends from the end of the boom 88, as illustrated in FIG. 1, to the other end of the boom 88, and then down the lance 152. The supply pipe 220 then narrows (see especially FIG. 3) at the lower end of the lance 152, where it enters the mounting plate 160, the swivel bracket 164, the water ring 196, and then the nozzle inlet 38.

In the preferred embodiment, a protective cover (not shown) encloses the plate 160, the water ring 196, and the swivel bracket 164 to keep refractory material away from the swivel bracket 164. Further, a generally vertical nozzle (not shown) is substituted for the T-shaped nozzle 34 after the tundish sides 22 are lined in order to line the tundish lower end 18. A cable support bar 224 and a box 228 are also provided on the base 46 to keep cables 232 connected to the electrical equipment clear of the apparatus components. A plurality of support posts 236 having rollers thereon receive and support the cables 232 as the apparatus 10 moves along the track 14. A flexible metal shield 240 covers the cables 232 as the apparatus 10 moves along the tracks 54 to prevent falling objects from damaging the cables 232.

As illustrated in FIG. 5, the nozzle outlet 42 is generally oblong in the vertical direction. In the preferred embodiment, the opening is about $\frac{3}{8}$ inch wide by $2\frac{1}{4}$ inches long. This nozzle outlet configuration has been found to cause the wetted refractory material to more effectively stick to the tundish 14 thereby reducing the amount of wasted material.

The fluidized refractory material needs to travel through some 35 feet of piping before it eventually reaches the nozzle outlet 42. In order to limit the amount of abrasion to the piping 220 caused by this abrasive material, it is desirable to reduce the amount of pressurized air used to fluidize the material prior to its arrival at the nozzle outlet 42. The apparatus 10 thus further includes means for supplying air to the nozzle outlet 42 to assist in the propelling of the wetted refractory material against the tundish 14. More particularly a source of pressured air connected to an air regulator (not shown) is connected by tubing to the air inlet 188. By providing extra pressurized air only at the nozzle outlet 42 in order to obtain proper adhesion of the material to the tundish 14, the amount of abrasion of the piping 220 occurring because of the material is reduced.

The apparatus 10 also includes means for operating the x or base y or cradle, z or boom, and w or nozzle moving means in a coordinated fashion. More particular, as illustrated schematically in FIG. 9, the moving operating means comprises a computer numerical control (CNC) connected to each of the x, y, z and w motors 72, 112, 136 and 168, respectively. The particular connection to the x motor is shown in FIG. 9. The other motors are connected to the CNC in a similar fashion.

The CNC includes a memory which provides stored information to the CNC regarding between what horizontal and vertical periphery coordinates the nozzle 34 must travel in order to line the tundish 14. More particularly, the CNC memory records the number of motor revolutions required to move the nozzle 34 between the various coordinates. This information is supplied to servodrive units provided for each motor, which in turn instruct a motor controller to have the motor operate for so many revolutions. An encoder keeps track of the number of revolutions actually taken by the motor. This information is returned to the motor servodrive units, which in turn conveys the information to the CNC.

Originally, an operator only needs to manually take the apparatus to each of the tundish horizontal and vertical periphery coordinates. The CNC stores this information, and thereafter automatically coordinates the movement of the x, y, z and w motors in order to completely line the tundish 14.

Although other methods of lining the tundish 14 may be used in other embodiments, the apparatus 10 begins at a periphery coordinate at the open upper end of the tundish 14, and then proceeds to line the tundish sides 22 by travelling around the tundish 14 and by rotating the nozzle outlet 42 through about 360°. The nozzle 34 is then dropped down, and another line of refractory material is applied to the tundish 14 by rotating the nozzle outlet 42 through about 360° in the opposite direction. This process continues until all of the tundish sides 22 are lined. The tundish lower end 18 is then lined using a vertical nozzle (not shown).

Various other features of the invention are set forth in the following claims.

I claim:

1. A gunning apparatus which is adapted to move along the inside of a tundish or ladle having a generally closed lower end, enclosed sides, and an open other end, and which sprays the sides and lower end thereof with refractory gunning material, said apparatus comprising a base, an upright support beam attached to said base, means for moving said base horizontally along the tundish parallel to one of said sides, a horizontal boom extending generally perpendicularly to the direction of travel of said base and extending over the open upper end of the tundish, a cradle slidably mounted on said support beam and slidably supporting said boom, means for moving said boom horizontally relative to said cradle perpendicular to the direction of travel of said base, means for moving said cradle vertically relative to said support beam, a lance attached to said boom and perpendicular thereto, which extends generally into the tundish, and which has a lower end, a nozzle having an inlet and an outlet, means for rotatably mounting said nozzle on said lance lower end so that said nozzle outlet is generally perpendicular to said lance, means for rotatably moving said nozzle relative to said lance, means for supplying fluidized refractory material to said nozzle inlet, means for wetting the fluidized material before said nozzle outlet, and means for supplying water to said wetting means.

2. An apparatus in accordance with claim 1 wherein said base moving means comprises a track extending generally along one of the sides of the tundish, means for permitting movement of said base along said track, a chain extending the length of said track and fixed relative to said track, and a motor which is connected to said base, and which engages said chain so that said base moves along said track when said motor operates.

3. An apparatus in accordance with claim 1 wherein said means for rotatably mounting said nozzle on said lance comprises a mounting plate attached to said lance, and a swivel bracket rotatably mounted on said mounting plate, and wherein said nozzle is attached to said swivel bracket, and wherein said means for rotatably moving said nozzle comprises a motor for engaging said swivel bracket so that said swivel bracket rotates when said motor operates.

4. An apparatus in accordance with claim 1 wherein said boom and said lance are hollow, and wherein said water and material supplying means extend through said boom and said lance.

5. An apparatus in accordance with claim 1 wherein said cradle moving means comprises a screw mounted adjacent said support beam and extending the length of said support beam, means for rotating said screw, and a nut attached to said cradle and receiving said screw so that said cradle moves relative to said support beam when said screw turns.

6. An apparatus in accordance with claim 1 wherein said boom moving means comprises a rack on said boom and extending along the length thereof, and a motor on said cradle for engaging said rack so that said boom moves relative to said cradle when said motor operates.

7. An apparatus in accordance with claim 1 wherein said nozzle outlet is generally oblong in a vertical direction.

8. An apparatus in accordance with claim 1 wherein said apparatus further includes means for operating said base, cradle, boom and nozzle moving means in a coordinated fashion, said operating means comprising a computer numerical controller connected to each of said base, cradle, boom and nozzle moving means.

9. A gunning apparatus which is adapted to move along the inside of a tundish or ladle having a generally closed lower end, enclosed sides, and an open upper end, and which sprays the sides and lower end thereof with refractory gunning material, said apparatus comprising a nozzle having a material inlet, an air inlet, and an outlet supplied by said material inlet and said air inlet, means for supporting said nozzle inside the tundish, x means for moving said nozzle support in an x direction generally horizontally along the tundish parallel to one of said sides, y means for moving said nozzle support in a vertical y direction, z means for moving said nozzle support in a z direction generally perpendicular to said x and y directions, w means for rotating said nozzle outlet about an axis extending in said y direction, means for supplying fluidized refractory material to said nozzle material inlet, means for wetting the fluidized material before said nozzle outlet, means for supplying water to said wetting means, and means for supplying air to said nozzle air inlet to assist in propelling the wetted refractory material against the tundish.

10. An apparatus in accordance with claim 9 wherein said apparatus further includes means for operating said x, y, z and w moving means in a coordinated fashion, said operating means comprising a computer numerical controller connected to each of said x, y, z and w moving means.

* * * * *

UNITED STATES PATENT AND TRADEMARK OFFICE

CERTIFICATE OF CORRECTION

PATENT NO. : 4,901,985

DATED : February 20, 1990

INVENTOR(S) : Madjid Soofi

It is certified that error appears in the above-identified patent and that said Letters Patent is hereby corrected as shown below:

In column 1, line 8, after "steel" please insert --.--.

In column 1, line 14, after "tundishes" please insert --,--.

In column 2, line 20, after "memorized" please insert --,--.

In column 2, line 64, after "drawings" please insert --.--.

In column 3, line 16, after "8" please insert --,--.

In column 4, line 52, after "end" please insert --,--.

In column 5, line 13, after "thereof" please insert --,--.

In column 5, line 15, please delete "exists" and substitute therefor --exits--.

UNITED STATES PATENT AND TRADEMARK OFFICE

CERTIFICATE OF CORRECTION

PATENT NO. : 4,901,985

DATED : February 20, 1990

INVENTOR(S) : Madjid Soofi

It is certified that error appears in the above-identified patent and that said Letters Patent is hereby corrected as shown below:

In column 6, line 4, after "particularly" please insert --,--.

In column 6, line 12, after "base" please insert --,--.

Signed and Sealed this

Twenty-fifth Day of August, 1992

*Attest:*

DOUGLAS B. COMER

*Attesting Officer*

*Acting Commissioner of Patents and Trademarks*